US008439218B1

(12) United States Patent
Watts

(10) Patent No.: US 8,439,218 B1
(45) Date of Patent: May 14, 2013

(54) DUMPSTER LID OPENING SYSTEM

(76) Inventor: Gerald W. Watts, Clearwater, FL (US)

( * ) Notice: Subject to any disclaimer, the term of this patent is extended or adjusted under 35 U.S.C. 154(b) by 333 days.

(21) Appl. No.: 12/803,795

(22) Filed: Jul. 8, 2010

(51) Int. Cl.
*B65D 43/26* (2006.01)

(52) U.S. Cl.
USPC ..... 220/263; 220/262; 220/264; 220/908

(58) Field of Classification Search ..... 220/260, 220/262, 263, 264, 830
See application file for complete search history.

(56) References Cited

U.S. PATENT DOCUMENTS

| | | | | |
|---|---|---|---|---|
| 2,565,361 | A * | 8/1951 | Elm | 220/201 |
| 3,201,075 | A * | 8/1965 | Sievers | 248/147 |
| 3,249,294 | A * | 5/1966 | Hughes et al. | 232/43.2 |
| 3,450,297 | A * | 6/1969 | Clerk | 220/263 |
| 4,081,105 | A * | 3/1978 | Dagonnet et al. | 220/263 |
| 4,164,178 | A * | 8/1979 | Baumann et al. | 100/99 |
| 4,892,218 | A * | 1/1990 | Reiling | 220/263 |
| 5,011,036 | A * | 4/1991 | Souza et al. | 220/263 |
| 5,048,712 | A * | 9/1991 | Wolters | 220/262 |
| 5,147,056 | A * | 9/1992 | Ma | 220/263 |
| 5,372,271 | A * | 12/1994 | Miller et al. | 220/263 |
| 5,897,014 | A * | 4/1999 | English | 220/263 |
| 6,024,238 | A * | 2/2000 | Jaros | 220/264 |
| 6,039,200 | A * | 3/2000 | Armor | 220/263 |
| 6,138,855 | A * | 10/2000 | Kopf | 220/263 |
| 6,209,744 | B1 * | 4/2001 | Gill | 220/263 |
| 7,070,064 | B1 * | 7/2006 | Henry et al. | 220/262 |
| D555,318 | S * | 11/2007 | Lin | D34/9 |
| 7,350,663 | B2 * | 4/2008 | Chomik et al. | 220/264 |
| 7,490,545 | B2 * | 2/2009 | Baghdoian | 100/226 |
| 7,543,716 | B2 * | 6/2009 | Lin | 220/495.11 |
| 7,703,622 | B1 * | 4/2010 | Bynoe | 220/263 |
| 7,878,358 | B2 * | 2/2011 | Smudde | 220/23.88 |
| 8,136,688 | B2 * | 3/2012 | Lee et al. | 220/262 |
| 8,146,767 | B1 * | 4/2012 | Grant | 220/263 |
| 8,266,730 | B2 * | 9/2012 | Ricca | 4/246.3 |
| 2004/0089663 | A1 * | 5/2004 | Finkelstein | 220/263 |
| 2004/0134914 | A1 * | 7/2004 | Richards | 220/263 |
| 2004/0164077 | A1 * | 8/2004 | Kuo | 220/263 |
| 2009/0236340 | A1 * | 9/2009 | Joordens | 220/263 |
| 2011/0120997 | A1 * | 5/2011 | Most | 220/263 |

FOREIGN PATENT DOCUMENTS

| | | | |
|---|---|---|---|
| DE | 3701270 | A1 * | 9/1987 |
| DE | 4227705 | A1 * | 4/1993 |
| GB | 2065455 | A * | 7/1981 |

* cited by examiner

*Primary Examiner* — Anthony Stashick
*Assistant Examiner* — Chetan Chandra

(57) ABSTRACT

A container has a base plate, front, rear and side walls. A chamber is defined between the walls. A lid is pivotably coupled to the rear wall. A pivot bar is attached to the lid. A long extent is attached to the lid and a short extent. An actuator housing with a trolley is movable between top and bottom positions. A spring urges the trolley to the top position. A pedal coupled to the trolley is adapted to be depressed by a user to move the trolley to the bottom position. A connector has an interior end attached to the trolley. The connector has an exterior end attached to the short extent of the pivot bar. In this manner the depression the pedal will move the connector to raise the lid. Also in this manner the release of the pedal will cause the spring to lower the lid.

4 Claims, 7 Drawing Sheets

68
50,52
82
58
64
56
66
60
62
70

DUMPSTER LID OPENING SYSTEM

BACKGROUND OF THE INVENTION

Field of the Invention

The present invention relates to a dumpster lid opening system and more particularly pertains to raising and lowering dumpster lids hands free, solely through foot pedals, the raising and lowering being done in a safe, sanitary, convenient and economic manner.

SUMMARY OF THE INVENTION

In view of the foregoing disadvantages inherent in the known types of lid systems of known designs and configurations now present in the prior art, the present invention provides an improved dumpster lid opening system. As such, the general purpose of the present invention, which will be described subsequently in greater detail, is to provide a new and improved dumpster lid opening system and method which has all the advantages of the prior art and none of the disadvantages.

To attain this, the present invention essentially comprises a dumpster lid opening system. First provided is a container. The container has a rectangular horizontal base plate. The container has a rectangular vertical front wall. The container has a rectangular vertical rear wall. The container also has vertical first and second side walls. The side walls are provided parallel to each other. The side walls are generally rectangular. The side walls, the front wall and the rear wall each have an upper edge. The front and rear walls have a height. The rear wall height is greater than the front wall height. The upper edges of the side walls are angled downwardly from the upper edge of the rear wall to the upper edge of the front wall. In this manner a chamber is defined between the walls. The chamber has an open top.

A first lid is provided. A second lid is also provided. The second lid is configured similarly to the first lid. A first hinge is provided. The first hinge is located above the rear wall adjacent to the first side wall. The first lid is pivotably coupled to the first hinge. A second hinge is provided. The second hinge is located above the rear wall adjacent to the second side wall. The second lid is pivotably coupled to the second hinge. Each lid is adapted to be independently pivoted between a lowered closed orientation covering the opening of the container and a raised vertical open orientation above the rear wall.

Provided next is a first pivot bar. A second pivot bar is also provided. Each pivot bar is attached to a lid. Each pivot bar is located parallel to and spaced from the side walls. Each pivot bar has a long extent. The long extent is attached to an associated lid. Each pivot bar has a short extent. The short extent extends upwardly from the long extent at an angle of about 30 degrees, plus or minus 10 percent.

Further provided is a first actuator housing. The first actuator housing is secured to the front wall of the housing adjacent to the first lid. A second actuator housing is also provided. The second actuator housing is secured to the front wall of the housing adjacent to the second lid. A first trolley is provided. The first trolley is provided in the first actuator housing. The first trolley has four wheels. In this manner the trolley may be moved between a top rest position and a bottom operational position. A second trolley is provided. The second trolley is provided in the second actuator housing. The second trolley has four wheels. In this manner the trolley may be moved between a top rest position and a bottom operational position.

First and second springs are provided. In this manner the first and second trolleys are urged to their top rest position. First and second pedals are provided. The first and second pedals are coupled to first and second trolleys. A tension coil spring is provided. The first and second pedals are adapted to be depressed by a user against the urging of the tension coil spring to the bottom operational positions. The first and second pedals are adapted to be pivoted to a horizontal operative position by a foot of the user. Fixed and rotatable stop shoulders are provided. In this manner to rotation of each pedal upon reaching horizontal is limited. Further in this manner continued pressure by the foot of the user lowers its associated trolley and stretches its associated spring. First and second upper sprockets are provided. The first and second upper sprockets are rotatable in the first and second housings. First and second lower sprockets are provided. The first and second lower sprockets are rotatable in the first and second housings. First and second pulleys are provided. The first and second pulleys are provided beneath the rear wall.

Provided last is a first flexible connector. The first flexible connector has an interior end. The interior end is attached to the first trolley. The first flexible connector has an exterior end. The exterior end is attached to the short extent of the first pivot bar. A second flexible connector is provided. The second flexible connector has an interior end. The interior end is attached to the second trolley. The second flexible connector has an exterior end. The exterior end is attached to the short extent of the second pivot bar. Each flexible connector is formed as a cable from the pivot bar then extending vertically adjacent to the rear wall then around its associated pulley and then horizontal beneath the base plate. The flexible connector includes a chain. The chain couples from the cable around an associated lower sprocket and then around the upper sprocket and then to its associated trolley. In this manner the depression of one of the pedals will move its associated connector to raise its associated lid. Further in this manner the release of the one of the pedals will cause its associated spring to lower its associated lid.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dumpster lid opening system which has all of the advantages of the prior art lid systems of known designs and configurations and none of the disadvantages.

It is another object of the present invention to provide a new and improved dumpster lid opening system which may be easily and efficiently manufactured and marketed.

It is further object of the present invention to provide a new and improved dumpster lid opening system which is of durable and reliable constructions.

An even further object of the present invention is to provide a new and improved dumpster lid opening system which is susceptible of a low cost of manufacture with regard to both materials and labor, and which accordingly is then susceptible of low prices of sale to the consuming public, thereby making such dumpster lid opening system economically available to the buying public.

Even still another object of the present invention is to provide a dumpster lid opening system for raising and lowering dumpster lids hands free, solely through foot pedals, the raising and lowering being done in a safe, sanitary, convenient and economic manner.

Lastly, it is an object of the present invention to provide a new and improved dumpster lid opening system. A container has a base plate, front, rear and side walls. A chamber is defined between the walls. A lid is pivotably coupled to the rear wall. A pivot bar is attached to the lid. A long extent is attached to the lid and a short extent. An actuator housing with a trolley is movable between top and bottom positions. A spring urges the trolley to the top position. A pedal coupled to the trolley is adapted to be depressed by a user to move the trolley to the bottom position. A connector has an interior end attached to the trolley. The connector has an exterior end attached to the short extent of the pivot bar. In this manner the depression the pedal will move the connector to raise the lid. Also in this manner the release of the pedal will cause the spring to lower the lid.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
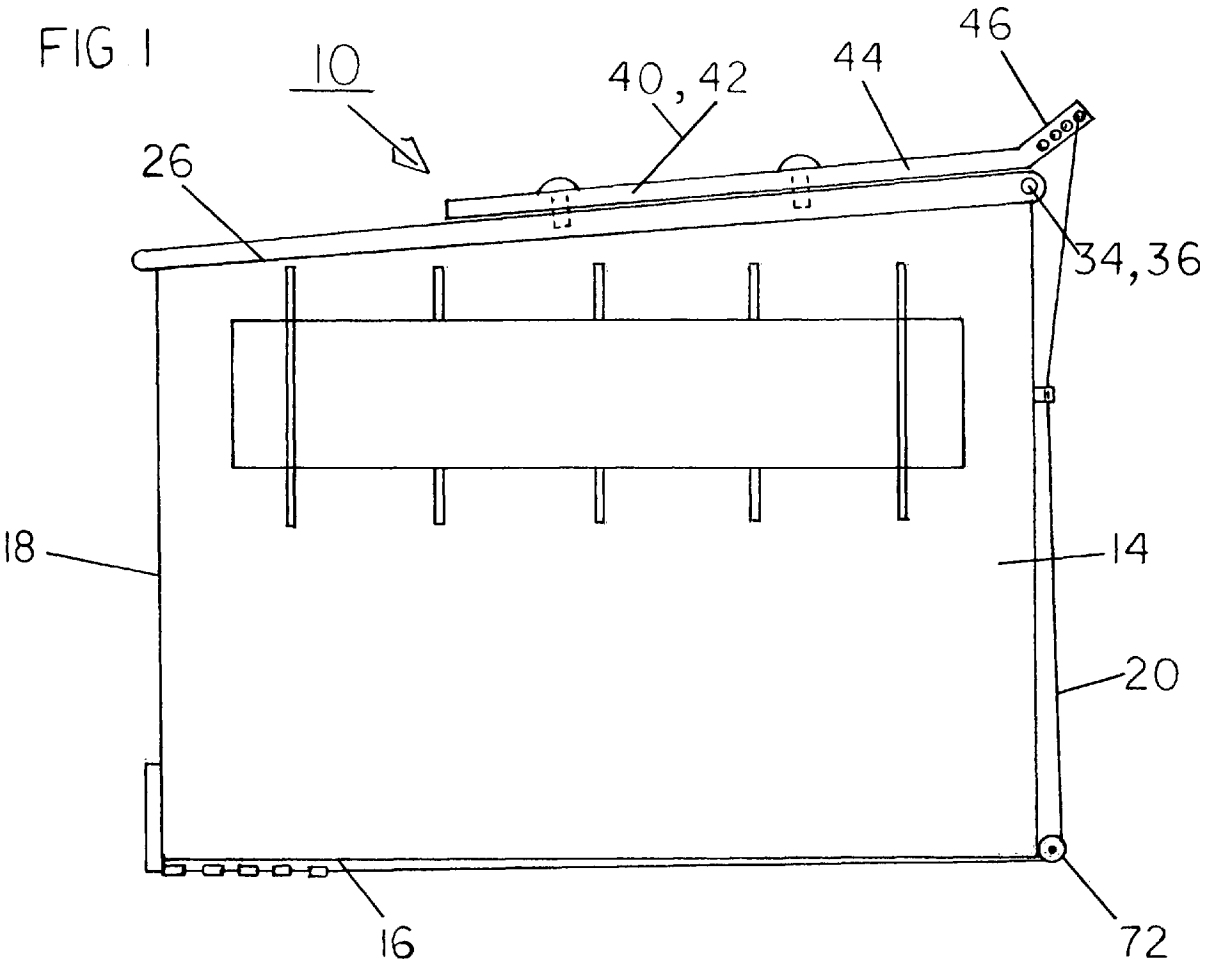
FIG. 1 is a side elevational view of a dumpster lid opening system constructed in accordance with the principles of the present invention.
Figure 2:
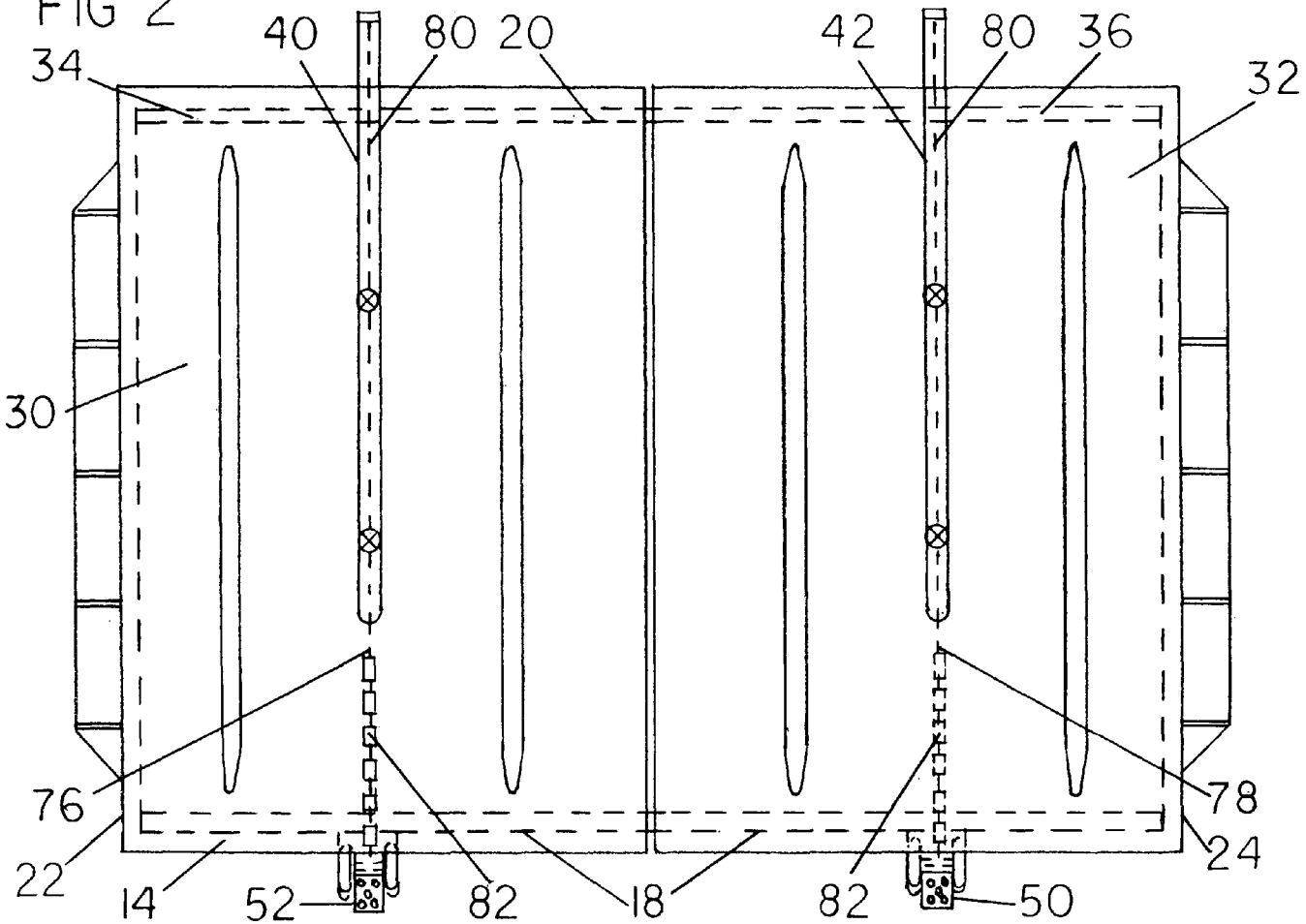
FIG. 2 is a plan view of the system taken along line 2-2 of FIG. 1.
Figure 3:
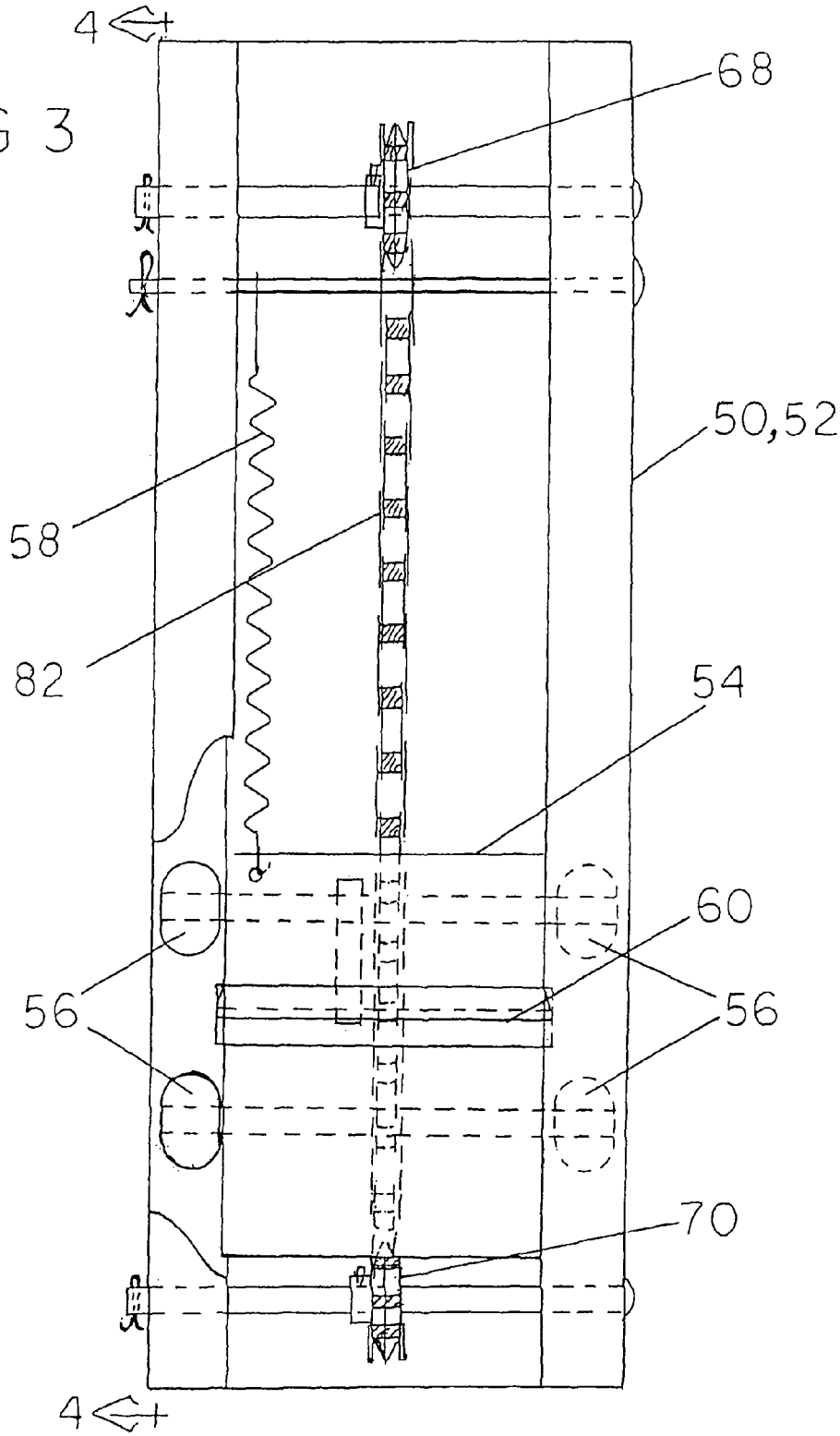
FIG. 3 is a front elevational view of a portion of the system taken along line 3-3 of FIG. 2.
Figure 4:
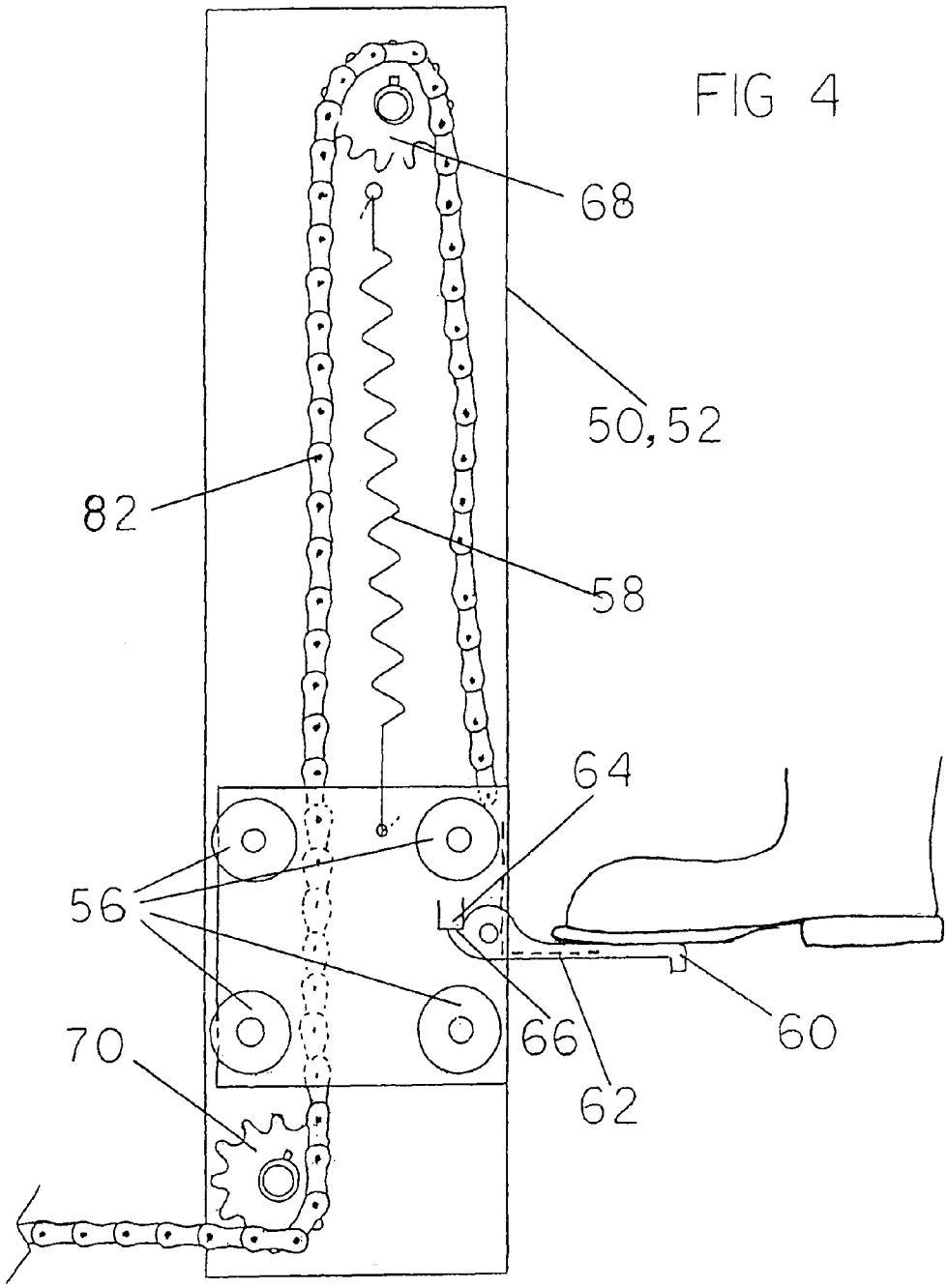
FIG. 4 is a side elevational view of a portion of the system taken along line 4-4 of FIG. 3.
Figure 5:
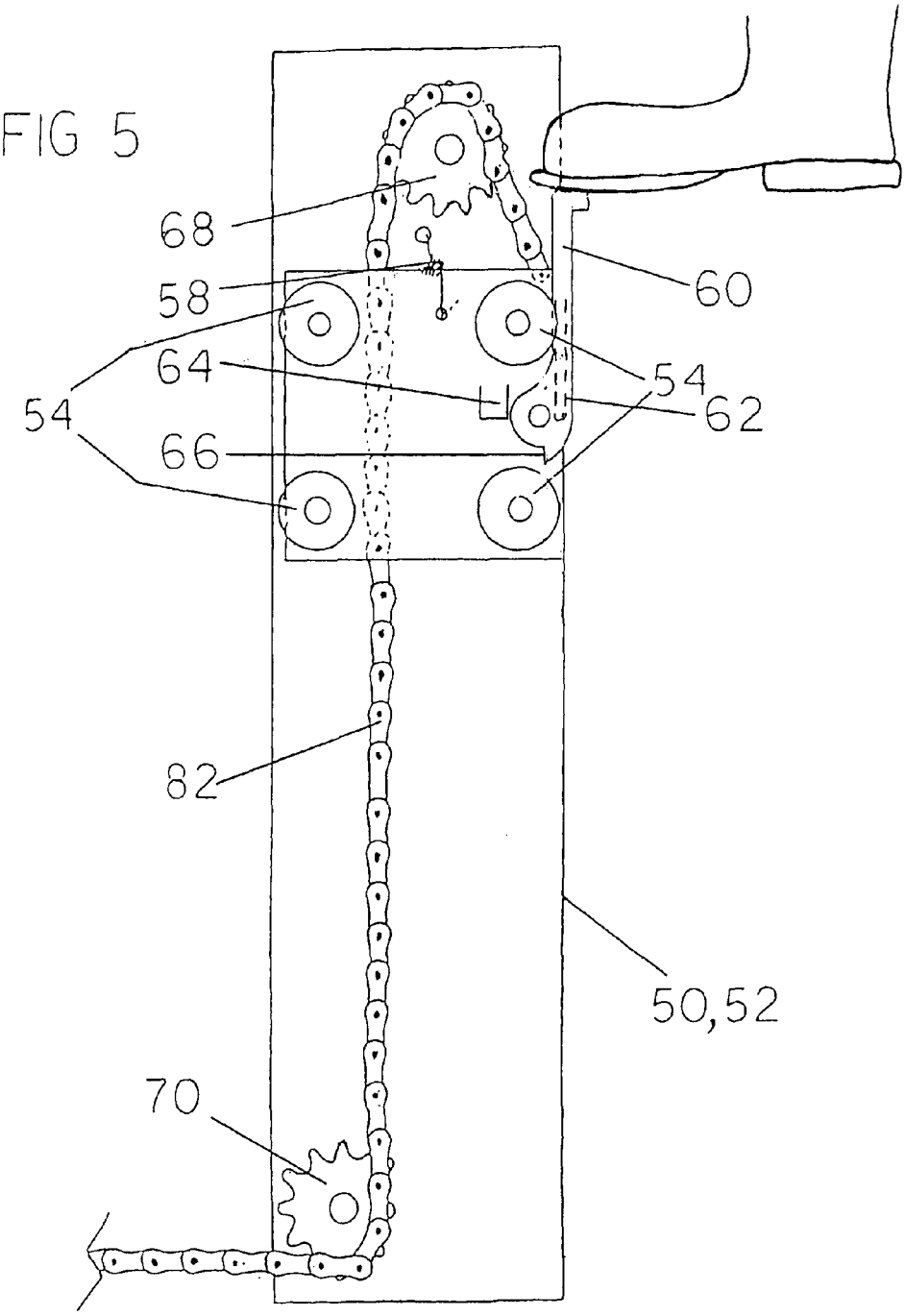
FIG. 5 is a side elevational view similar to FIG. 4 but showing the pedal in a raised orientation.

With reference now to the drawings, and in particular to FIG. 1 thereof, the preferred embodiment of the new and improved dumpster lid opening system embodying the principles and concepts of the present invention and generally designated by the reference numeral 10 will be described.

The present invention, the dumpster lid opening system 10 is comprised of a plurality of components. Such components in their broadest context include a container, a lid, a pivot bar, an actuator housing, a pedal and a connector. Such components are individually configured and correlated with respect to each other so as to attain the desired objective.

First provided is a container 14. The container has a rectangular horizontal base plate 16. The container has a rectangular vertical front wall 18. The container has a rectangular vertical rear wall 20. The container also has vertical first and second side walls 22, 24. The side walls are provided parallel to each other. The side walls are generally rectangular. The side walls, the front wall and the rear wall each have an upper edge. The front and rear walls have a height. The rear wall height is greater than the front wall height. The upper edges of the side walls are angled downwardly from the upper edge of the rear wall to the upper edge of the front wall. In this manner a chamber is defined between the walls. The chamber has an open top 26.

A first lid 30 is provided. A second lid 32 is also provided. The second lid is configured similarly to the first lid. A first hinge 34 is provided. The first hinge is located above the rear wall adjacent to the first side wall. The first lid is pivotably coupled to the first hinge. A second hinge 36 is provided. The second hinge is located above the rear wall adjacent to the second side wall. The second lid is pivotably coupled to the second hinge. Each lid is adapted to be independently pivoted between a lowered closed orientation covering the opening of the container and a raised vertical open orientation above the rear wall.

Provided next is a first pivot bar 40. A second pivot bar 42 is also provided. Each pivot bar is attached to a lid. Each pivot bar is located parallel to and spaced from the side walls. Each pivot bar has a long extent 44. The long extent is attached to an associated lid. Each pivot bar has a short extent 46. The short extent extends upwardly from the long extent at an angle of about 30 degrees, plus or minus 10 percent.

Further provided is a first actuator housing 50. The first actuator housing is secured to the front wall of the housing adjacent to the first lid. A second actuator housing 52 is also provided. The second actuator housing is secured to the front wall of the housing adjacent to the second lid. A first trolley 54 is provided. The first trolley is provided in the first actuator housing. The first trolley has four wheels 56. In this manner the trolley may be moved between a top rest position and a bottom operational position. A second trolley 54 is provided. The second trolley is provided in the second actuator housing. The second trolley has four wheels 56. In this manner the trolley may be moved between a top rest position and a bottom operational position. First and second springs 58 are provided. In this manner the first and second trolleys are urged to their top rest position. First and second pedals 60 are provided. The first and second pedals are coupled to first and second trolleys. A tension coil spring 62 is provided. The first and second pedals are adapted to be depressed by a user against the urging of the tension coil spring to the bottom operational positions. The first and second pedals are adapted to be pivoted to a horizontal operative position by a foot of the user. Fixed and rotatable stop shoulders 64, 66 are provided. In this manner to rotation of each pedal upon reaching horizontal is limited. Further in this manner continued pressure by the foot of the user lowers its associated trolley and stretches its associated spring. First and second upper sprockets 68 are provided. The first and second upper sprockets are rotatable in the first and second housings. First and second lower sprockets 70 are provided. The first and second lower sprockets are rotatable in the first and second housings. First and second pulleys 72 are provided. The first and second pulleys are provided beneath the rear wall.

Provided last is a first flexible connector 76. The first flexible connector has an interior end. The interior end is attached to the first trolley. The first flexible connector has an exterior end. The exterior end is attached to the short extent of the first pivot bar. A second flexible connector 78 is provided. The second flexible connector has an interior end. The interior end is attached to the second trolley. The second flexible connector has an exterior end. The exterior end is attached to the short extent of the second pivot bar. Each flexible connector is formed as a cable 80 from the pivot bar then extending vertically adjacent to the rear wall then around its associated pulley and then horizontal beneath the base plate. The flexible connector includes a chain 82. The chain couples from the cable around an associated lower sprocket and then around the upper sprocket and then to its associated trolley. In this manner the depression of one of the pedals will move its associated connector to raise its associated lid. Further in this manner the release of the one of the pedals will cause its associated spring to lower its associated lid.

Figure 6:
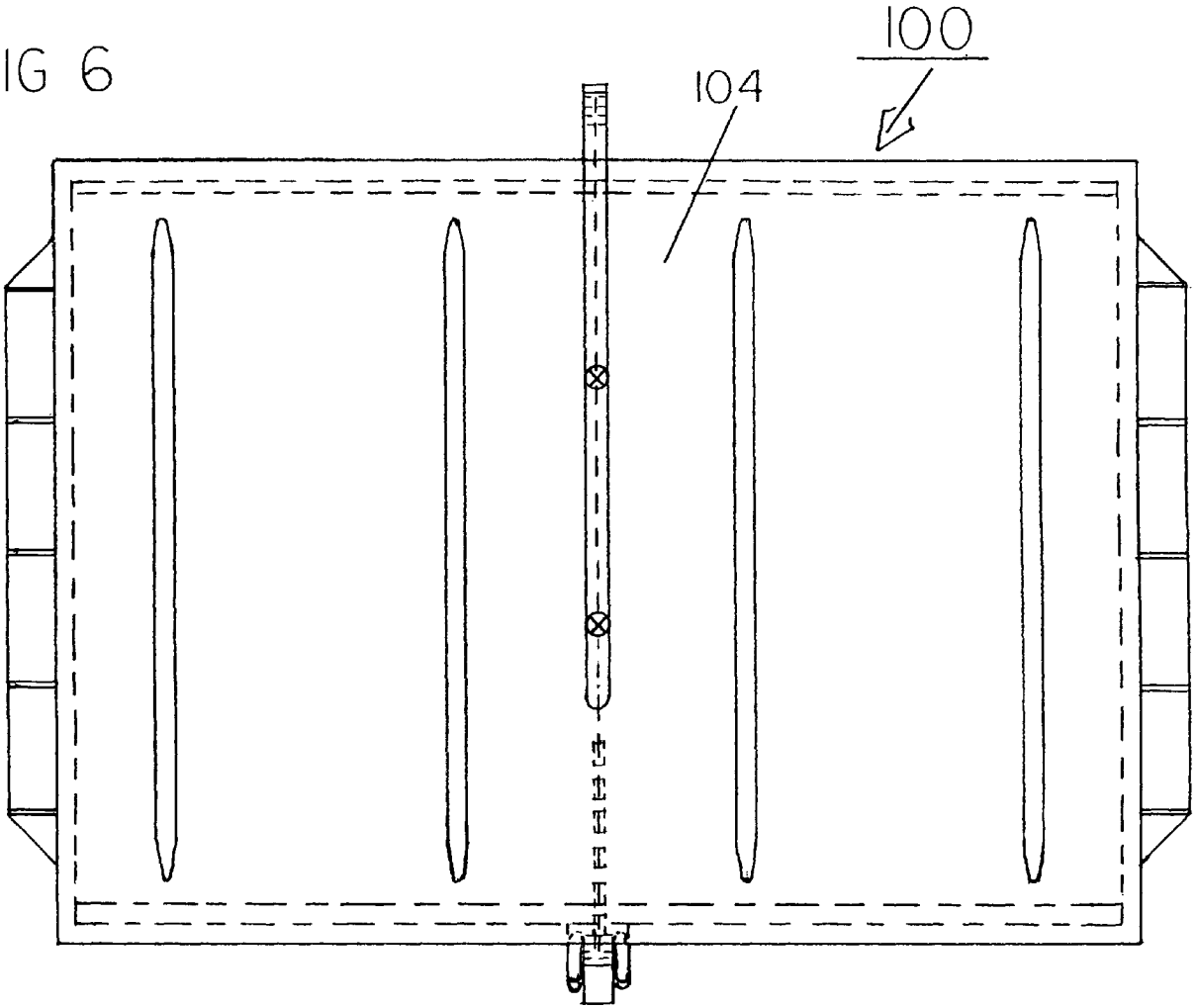
FIG. 6 is a plan view similar to FIG. 2 but illustrating an alternate embodiment of the invention.
Figure 7:
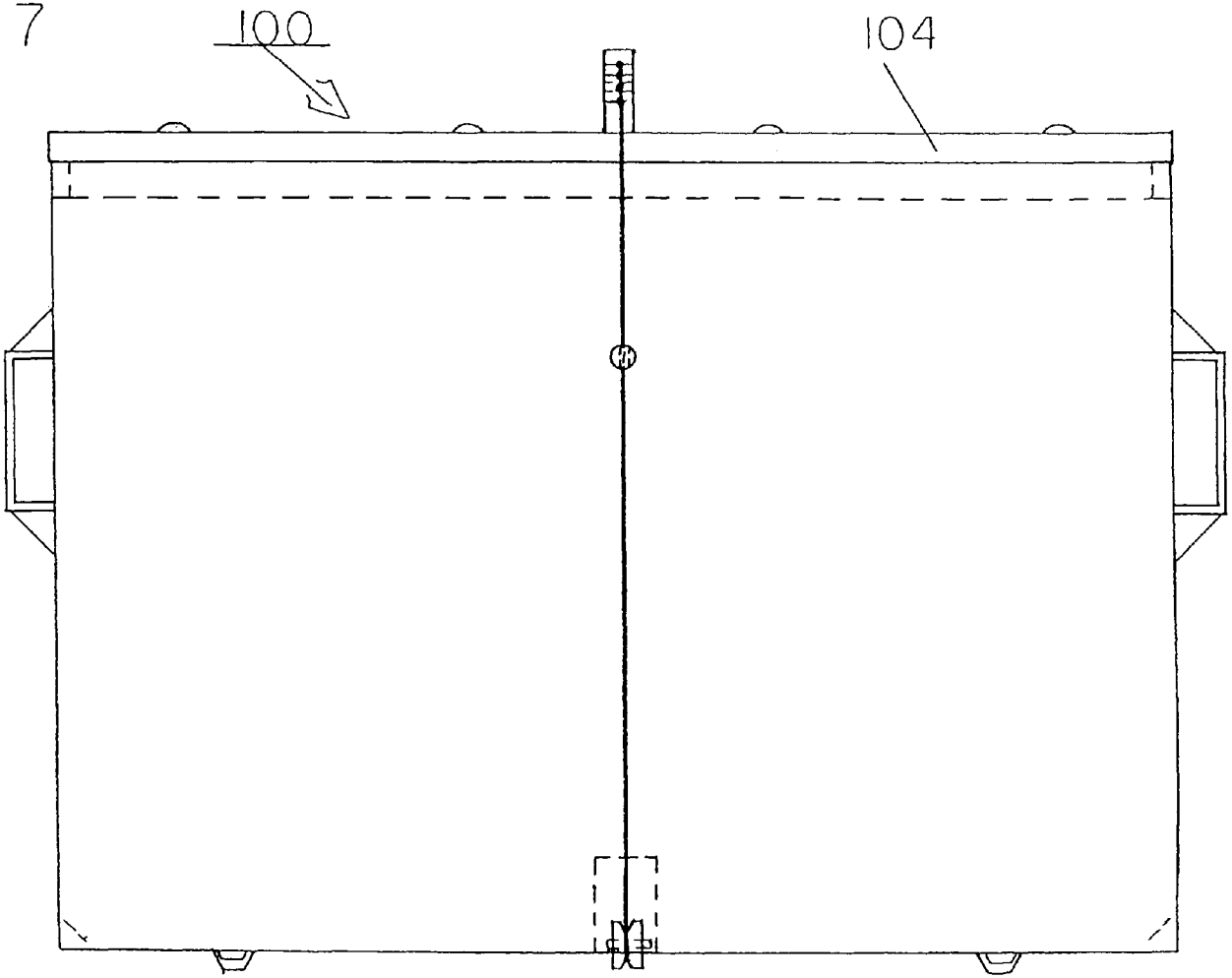
FIG. 7 is a rear elevational view of the system illustrated in FIG. 6.

An alternate embodiment 100 of the present invention is illustrated in FIG. 6. A lid 104 is provided. The lid covers the entire container.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dumpster lid opening system comprising;

a container having a base plate and a front wall and a rear wall and side walls defining a chamber there between;

a lid pivotably coupled to the rear wall;

a pivot bar attached to the lid with a long extent attached to the lid and a short extent;

an actuator housing with a trolley movable between a top position and a bottom position, a spring urging the trolley to the top position and, a plurality of wheels to move the trolley between the top position and the bottom position;

a pedal coupled to the trolley adapted to be depressed by a user to move the trolley to the bottom position; and a connector having an interior end attached to the trolley and an exterior end attached to the short extent of the pivot bar whereby the depression the pedal will move the connector to raise the lid while release of the pedal will cause the spring to lower the lid; and an upper sprocket and a lower sprocket, the sprockets being rotatable in the actuator housing and including a pulley beneath the rear wall wherein the connector includes a cable extending from the pivot bar then extending vertically adjacent to the rear wall then around the pulley and then horizontal beneath the base plate, the connector including a chain coupling from the cable around the lower sprocket and then around the upper sprocket and then to the trolley.

2. A dumpster lid opening system comprising;

a container having a base plate and a front wall and a rear wall and side walls defining a chamber there between;

a lid pivotably coupled to the rear wall;

a pivot bar attached to the lid with a long extent attached to the lid and a short extent;

an actuator housing with a trolley movable between a top position and a bottom position, a spring urging the trolley to the top position and, a plurality of wheels to move the trolley between the top position and the bottom position;

a pedal coupled to the trolley adapted to be depressed by a user to move the trolley to the bottom position; and a connector having an interior end attached to the trolley and an exterior end attached to the short extent of the pivot bar whereby the depression the pedal will move the connector to raise the lid while release of the pedal will cause the spring to lower the lid;

wherein the actuator housing also includes a plurality of wheels to move the trolley between the top position and the bottom position.

3. The system as set forth in claim 2 and further including stop shoulders to limit rotation of the pedal upon reaching horizontal whereby continued pressure by a foot of a user on the pedal will lower its associated trolley.

4. A dumpster lid opening system (10) for raising and lowering dumpster lids hands free, solely through foot pedals, the raising and lowering being done in a safe, sanitary, convenient and economic manner, the system comprising, in combination;

a container (14) having a rectangular horizontal base plate (16) and a rectangular vertical front wall (18) and a rectangular vertical rear wall (20) and parallel, vertical first and second side walls (22), (24), the side walls and the front wall and the rear wall each having an upper edge with the front and rear walls having a height, the rear wall height being greater than the front wall height, the upper edges of the side walls being angled downwardly from the upper edge of the rear wall to the upper edge of the front wall, the walls defining a chamber there between with an open top (26);

a first lid (30) and a similarly configured second lid (32), a first hinge (34) located above the rear wall adjacent to the first side wall, the first lid pivotably coupled to the first hinge, a second hinge (36) located above the rear wall adjacent to the second side wall, the second lid pivotably coupled to the second hinge, each lid adapted to be independently pivoted between a lowered closed orientation covering the opening of the container and a raised vertical open orientation above the rear wall;

a first pivot bar (40) attached to and associated with the first lid and a second pivot bar (42) attached to and associated with the second lid, each pivot bar being located parallel with and spaced from the side walls, each pivot bar having a long extent (44) attached to the associated lid and a short extent (46) extending upwardly from the long extent at an angle of 30 degrees, plus or minus 10 percent;

a first actuator housing (50) secured to the front wall of the housing adjacent to the first lid, a second actuator housing (52) secured to the front wall of the housing adjacent to the second lid, a first trolley (54) in the first actuator housing with four wheels (56) to move the first trolley between a top rest position and a bottom operational position, a second trolley (54) in the second actuator housing with four wheels (56) to move the second trolley between a top rest position and a bottom operational position, first and second springs (58) urging the first and second trolleys upwardly, respectively, first and second pedals (60) coupled to first and second trolleys, respectively, adapted to be depressed by a user against the urging of a tension coil spring (62) move the trolleys to the bottom operational positions, the first and second pedals adapted to be pivoted to a horizontal operative position by a foot of the user, stop shoulders (64), (66) to limit rotation of each pedal upon reaching horizontal whereby continued pressure by the foot of the user on the pedal will lower its associated trolley and stretch its associated spring, a first upper sprocket (68) rotatable in the first housing, a first lower sprocket (70) rotatable in the first housing, a first pulley (72) beneath the rear wall, a second upper sprocket rotatable in the second housing, a second lower sprocket rotatable in the second housing, a second pulley beneath the rear wall; and a first flexible connector (76) having an interior end attached to and associated with the first trolley and having an exterior end attached to the short extent of the first pivot bar, a second flexible connector (78) having an interior end attached to and associated with the second trolley and having an exterior end attached to the short extent of the second pivot bar, each flexible connector being formed as a cable (80) extending from a pivot bar then extending vertically adjacent to the rear wall then around the associated pulley and then horizontal beneath the base plate, each flexible connector including a chain (82) coupling from the associated cable around the associated lower sprocket and then around the associated upper sprocket and then to the associated trolley whereby the depression of the associated pedal will move the associated connector to raise the associated lid while release of the associated pedal will cause the associated spring to lower the associated lid.

* * * * *